US010571139B1

(12) United States Patent
Pyle et al.

(10) Patent No.: US 10,571,139 B1
(45) Date of Patent: Feb. 25, 2020

(54) MODULAR VENT FOR REMOVING ENTRAPPED MOISTURE WITH WIND

(71) Applicant: WINDSMART, LLC, Des Moines, IA (US)

(72) Inventors: Stephen Pyle, Des Moines, IA (US); Jim Johnson, Ames, IA (US); David Harvey, Clive, IA (US); Chris H. Hill, Ames, IA (US); Mark Williamson, Ames, IA (US); Andrew J. Six, Washington, IA (US); Cole Van Lent, Des Moines, IA (US)

(73) Assignee: WINDSMART, LLC, Des Moines, IA (US)

( * ) Notice: Subject to any disclaimer, the term of this patent is extended or adjusted under 35 U.S.C. 154(b) by 0 days.

(21) Appl. No.: 16/396,335

(22) Filed: Apr. 26, 2019

Related U.S. Application Data

(60) Provisional application No. 62/663,856, filed on Apr. 27, 2018, provisional application No. 62/785,069, filed on Dec. 26, 2018.

(51) Int. Cl.
*F24F 7/02* (2006.01)
*E04D 13/17* (2006.01)
*E04G 23/00* (2006.01)

(52) U.S. Cl.
CPC ..... *F24F 7/02* (2013.01); *E04D 13/17* (2013.01); *E04G 23/00* (2013.01)

(58) Field of Classification Search
CPC ... E04D 13/14–1415; F24F 7/02; E04G 23/00
USPC ..... 52/199
See application file for complete search history.

(56) References Cited

U.S. PATENT DOCUMENTS 2,806,419 A * 9/1957 Artis ..... E04D 13/0325 454/199
3,984,947 A * 10/1976 Patry ..... E04D 13/17 52/1
4,223,486 A 9/1980 Kelly
4,399,743 A * 8/1983 Izzi, Sr. ..... F23L 17/12 220/287
4,538,508 A * 9/1985 Ballard ..... B21D 53/00 137/852

(Continued)

FOREIGN PATENT DOCUMENTS

DE 202017103341 6/2017
EP 0247213 5/1986

(Continued)

OTHER PUBLICATIONS

Blauberg; Fresher 50 Jan. 1, 2018.

*Primary Examiner* — Babajide A Demuren
(74) *Attorney, Agent, or Firm* — David M. Breiner; BrownWinick Law Firm

(57) ABSTRACT

Disclosed is an equalization vent usable for venting and drying a roof. In accordance with example embodiments, the equalization vent may include a base, a cup arranged in the base, a flexible membrane arranged in the cup, an airflow guide arranged on the base and the cup, and a cover on the air flow guide, wherein the flexible membrane allows air to flow through the vent when the pressure outside of the vent is less than the pressure inside the base and prevents air from flowing through the vent when the pressure outside of the vent is greater than pressure inside the base.

14 Claims, 22 Drawing Sheets

(56) References Cited

U.S. PATENT DOCUMENTS

| | | | | |
|---|---|---|---|---|
| 4,593,504 | A * | 6/1986 | Bonnici | E04D 13/17 454/347 |
| 4,615,694 | A | 10/1986 | Raines | |
| 4,909,135 | A | 3/1990 | Greko | |
| 5,662,522 | A * | 9/1997 | Waltz | E04D 13/17 454/359 |
| 5,749,780 | A * | 5/1998 | Harder | E04D 13/1407 236/49.5 |
| 6,899,615 | B2 | 5/2005 | Gebke | |
| 7,001,266 | B2 | 2/2006 | Jones et al. | |
| 7,484,533 | B1 * | 2/2009 | Arndt | F16L 55/115 138/89 |
| 7,811,348 | B2 | 10/2010 | Paterson et al. | |
| 8,083,574 | B2 * | 12/2011 | Arnold, Jr. | B01D 53/864 454/4 |
| 8,869,796 | B2 | 10/2014 | Wood | |
| 9,322,369 | B2 | 4/2016 | Sasaki | |
| 9,422,725 | B1 | 8/2016 | Brookheart | |
| 9,566,860 | B2 | 2/2017 | Holzwarth et al. | |
| 2006/0288673 | A1 | 12/2006 | Wimmer | |
| 2007/0187306 | A1 | 8/2007 | Pecca | |
| 2017/0122600 | A1 | 5/2017 | Son et al. | |
| 2017/0246579 | A1 | 8/2017 | Mun et al. | |

FOREIGN PATENT DOCUMENTS

| | | |
|---|---|---|
| EP | 0640372 | 8/1994 |
| EP | 2705308 | 4/2012 |
| JP | 2002071180 | 8/2000 |
| KR | 20030011452 | 8/2001 |

* cited by examiner

MODULAR VENT FOR REMOVING ENTRAPPED MOISTURE WITH WIND

CROSS-REFERENCE TO RELATED APPLICATIONS

This application claims the benefit of U.S. Provisional Patent Application No. 62/663,856 which was filed with the United States Patent and Trademark Office on Apr. 27, 2018, the entire contents of which is herein incorporated by reference.

This application also claims the benefit of U.S. Provisional Patent Application No. 62/785,069 which was filed with the United States Patent and Trademark Office on Dec. 26, 2018, the entire contents of which is herein incorporated by reference.

BACKGROUND OF THE INVENTION

1. Field

Example embodiments relate to a vent usable for venting a roof and drying roof assemblies. The vent is especially useful when placed in the high wind uplift zones of a low sloped commercial roof (perimeter and corners).

2. Description of the Related Art

Membrane roof systems typically include a thermoset or thermoplastic sheet (membranes) that provides a moisture and vapor barrier. Membrane roofs are susceptible to damage from high winds which create a reduced pressure above the membrane causing it to lift from the building. To compensate for this problem, artisans typically install equalization vents in the roofs to reduce a pressure difference between an inside of a roof and an outside of the roof. This reduces the tendency of the roof to lift from the building.

Often, a technician must treat a roof before installing an equalization vent to ensure the roof can be properly vented. This often requires a portion of the roof be cut away (a process called coring) to expose an inner portion of the roof. After the roof is cored the vent is installed over the cored portion of the roof.

BRIEF SUMMARY OF THE INVENTION

The inventors have noted that many conventional equalization vents do an adequate job venting a roof when the roof is subject to a wind load so long as the roof is properly configured and the vent is properly installed. However, the inventors have noticed that there are problems associated with installation of conventional equalization vents. For example, in order to properly vent a roof a portion of the roof may need to be removed to a certain depth. Thereafter the equalization vent is installed over the cored roof. However, if an inspector wanted to inspect the coring after the equalization vent was installed, the inspector would have to remove the entire equalization vent to do so. This can be a difficult, expensive, and time consuming process and may result in damage to the roof. Thus, the inventors set out to design a new equalization vent to address the problem of inspection. To that end, the inventors invented a modular equalization vent having a removable cover and a base where the cover can be easily removed from the base and the base is configured to allow an inspector to view the cored roof through the base solving the aforementioned problem. In addition, the inventors found their invention not only allows for inspection of the roof but also allows the roof to be modified without having to remove the base from the roof. The base, for example, may allow a technician to more deeply core a roof by providing the technician enough access to the roof to perform a coring operation without having to remove the base. In the alternative, the base may allow a technician to add material, for example, foam, in the cored section in the event it is determined the coring was too deep. The addition of the material may be done without having to remove the base from the roof since the base is configured to provide enough work area for a technician to apply the material to the roof. This is a departure from using traditional equalization vents since bases of traditional equalization vents are required to be removed in order to execute the above cited operations.

In accordance with example embodiments, a method of modifying a roof may include taking a cover off an equalization vent while leaving a base of the equalization vent in place and attached to the roof, inspecting the roof by viewing inside the base of the equalization vent to determine whether the roof should be modified, and modifying the roof in the event the roof requires modification while the base remains attached to the roof.

In accordance with example embodiments, a modular vent may include a base and a cover on the base where the cover is attached to the base. In at least one example embodiment the cover is attached to the base by at least one fastener.

In accordance with example embodiments, an equalization vent may include a base, a cup arranged in the base, a flexible membrane arranged in the cup, an airflow guide arranged on the base and the cup, and a cover on the air flow guide, wherein the flexible membrane allows air to flow through the vent when the pressure outside of the vent is less than the pressure inside the base and prevents air from flowing through the vent when the pressure outside of the vent is greater than pressure inside the base.

In accordance with example embodiments, a method of evaluating a condition of a roof may include sending data from a moisture sensor arranged in a base of a equalization vent to a data analyzer, storing the data in an electronic database, using the data to determine a moisture level of the roof, and comparing the moisture level of the roof to an expected moisture level to determine whether the roof is in a proper condition.

BRIEF DESCRIPTION OF THE DRAWINGS

Example embodiments are described in detail below with reference to the attached drawing figures, wherein.

DETAILED DESCRIPTION

Figure 1:
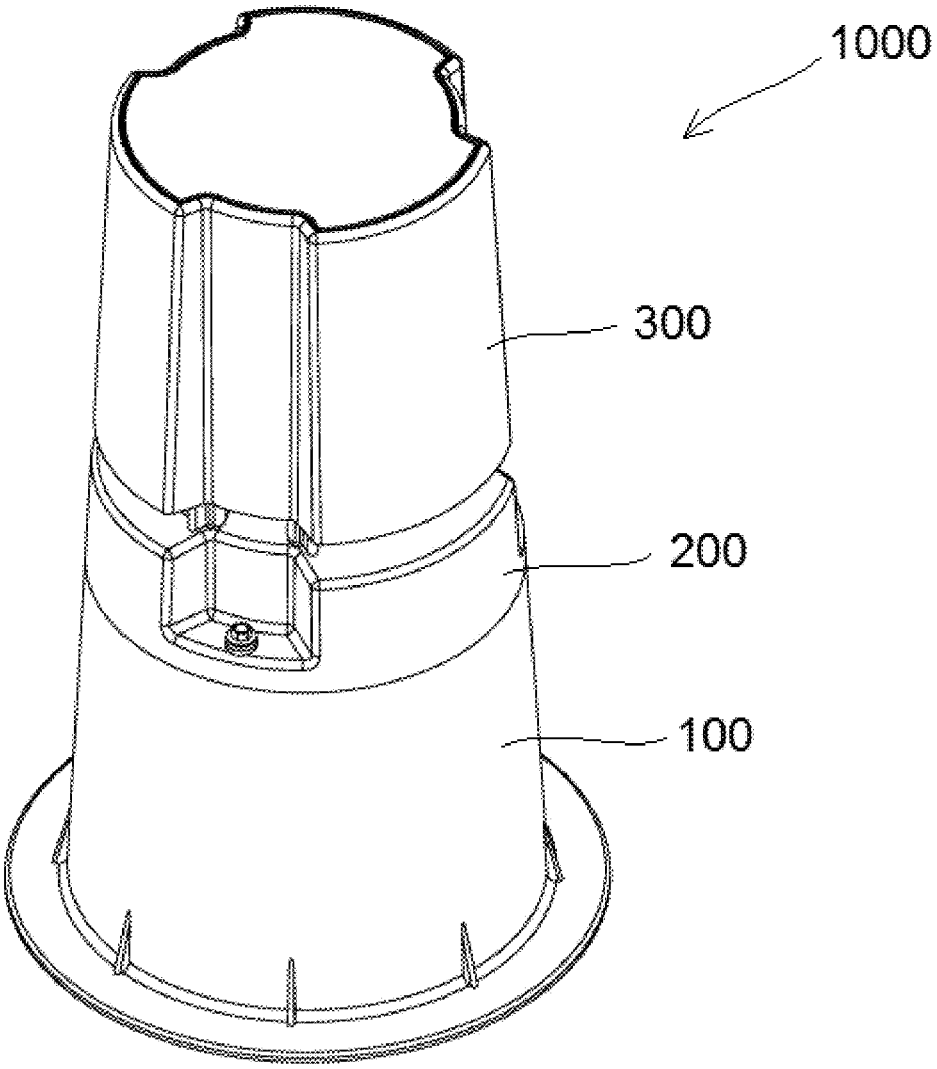
FIG. 1 is a perspective view of an equalization vent in accordance with example embodiments.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to an equalization vent usable for venting and drying a roof.

Figure 2:
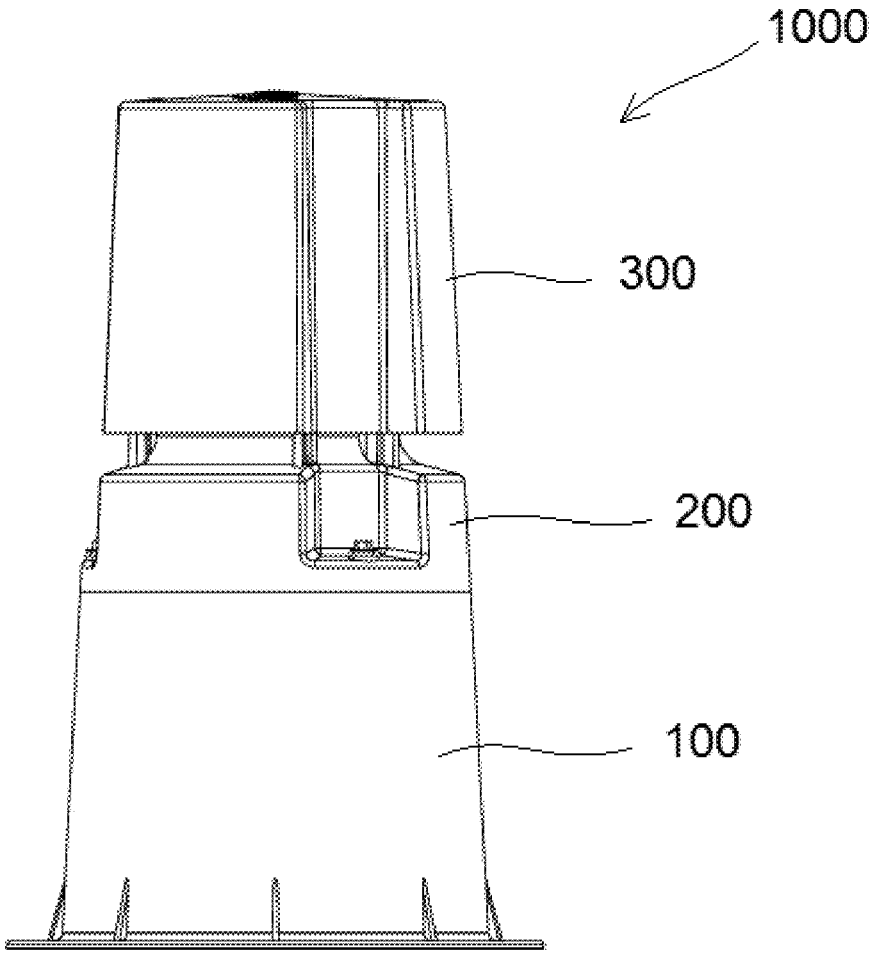
FIG. 2 is a first side view of the equalization vent in accordance with example embodiments.
Figure 3:
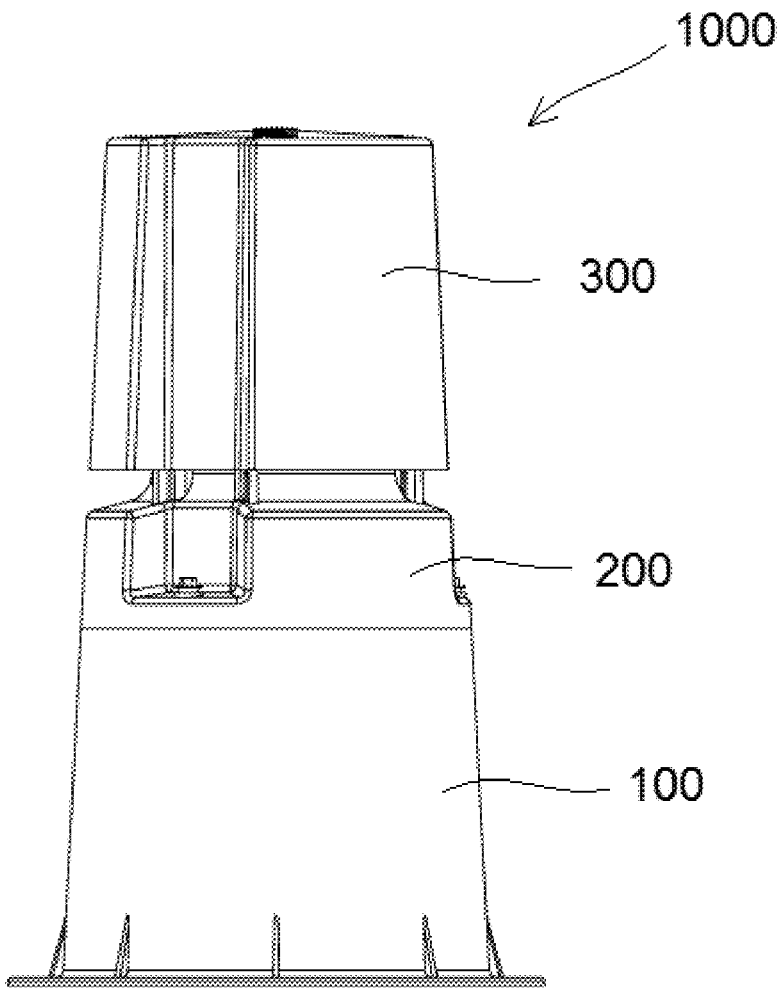
FIG. 3 is a second side view of the equalization vent in accordance with example embodiments.
Figure 4:
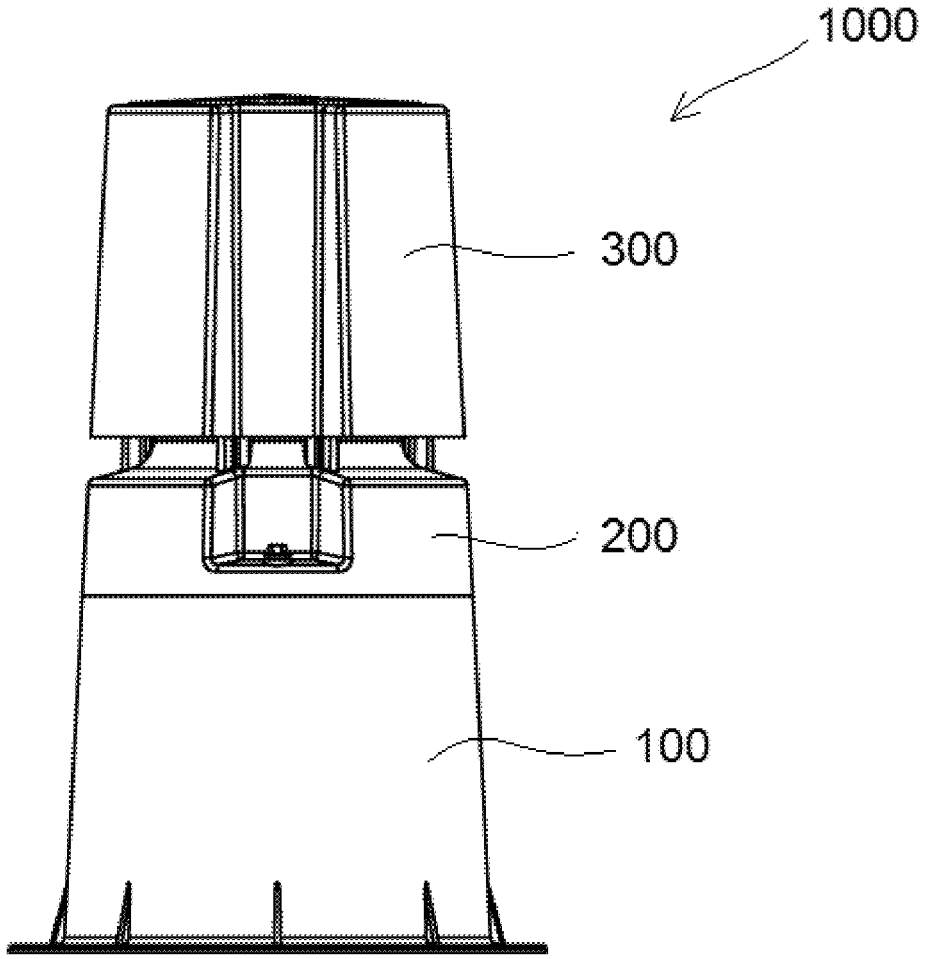
FIG. 4 is a front view of the equalization vent in accordance with example embodiments.
Figure 5:
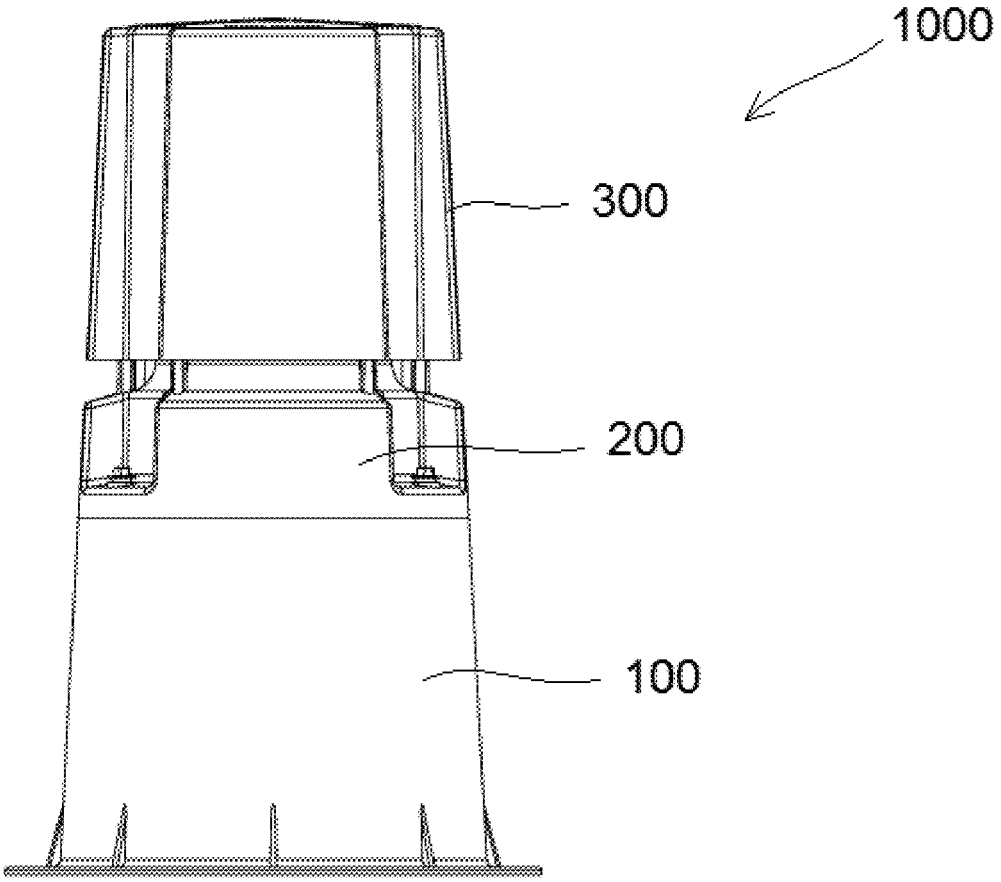
FIG. 5 is a back view of the equalization vent in accordance with example embodiments.
Figure 6:
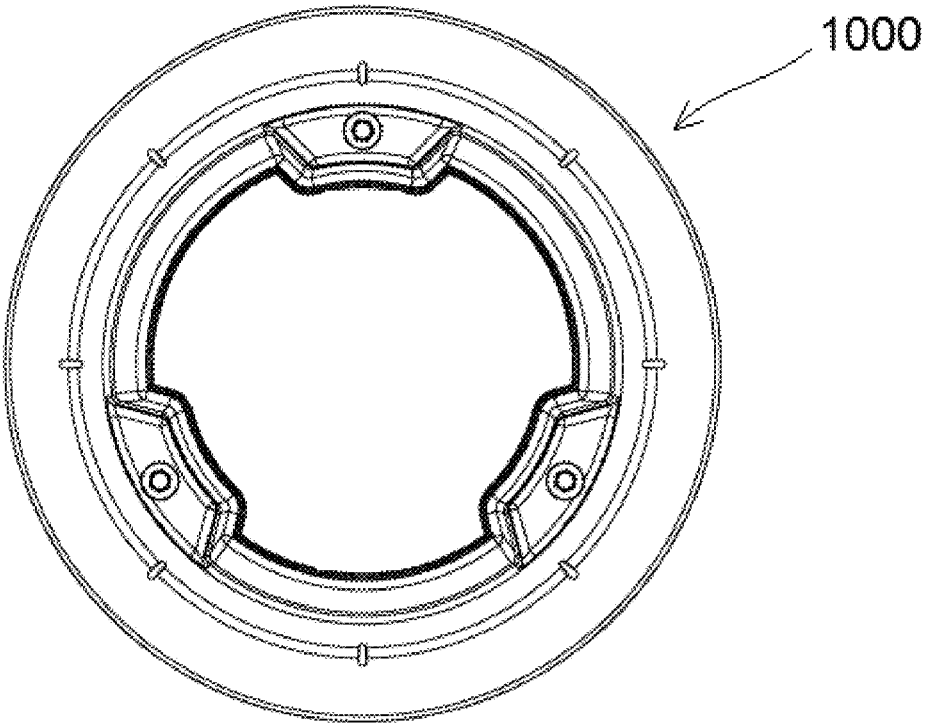
FIG. 6 is a top view of the equalization vent in accordance with example embodiments.
Figure 7:
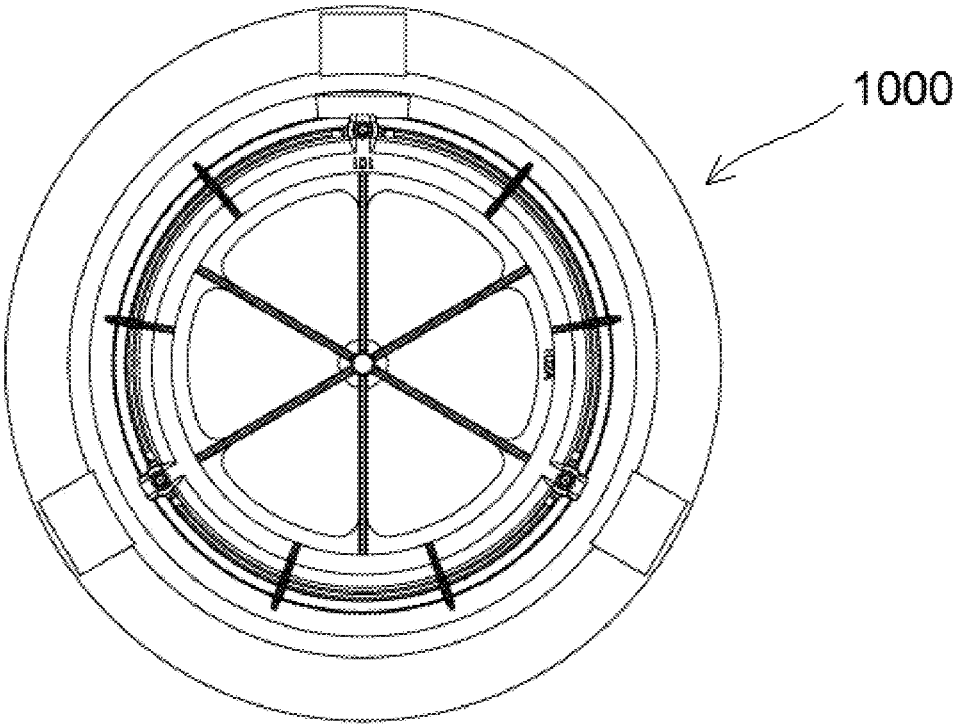
FIG. 7 is a bottom view of the equalization vent in accordance with example embodiments.
Figure 8:
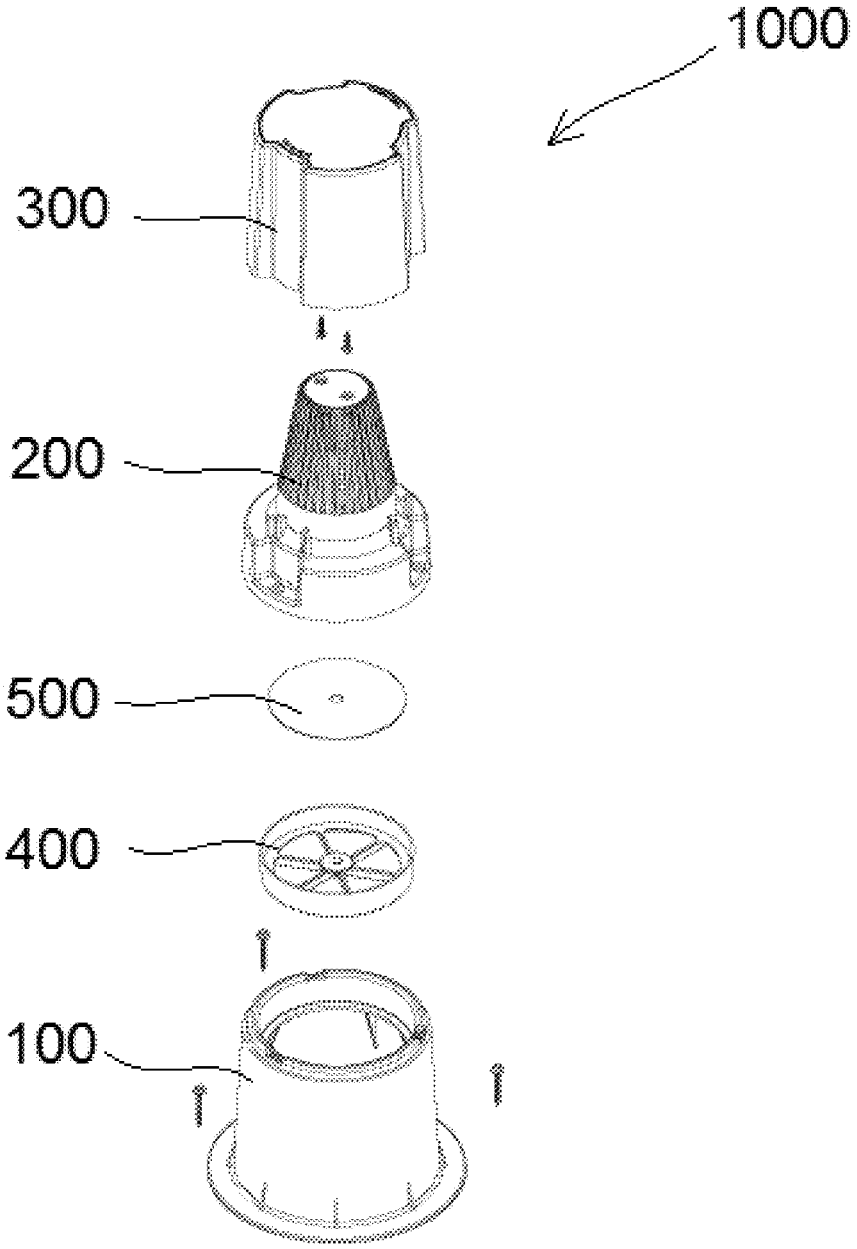
FIG. 8 is an exploded view of the equalization vent in accordance with example embodiments.

FIG. 1 is a perspective view of an equalization vent 1000 in accordance with example embodiments. FIG. 2 is a first side view of the vent 1000 (for example, a left side view), FIG. 3 is a second side view of the vent 1000 (for example, a right side view), FIG. 4 is a front view of the vent 1000, FIG. 5 is a back view of the vent 1000, FIG. 6 is a top view of the vent 1000, and FIG. 7 is a bottom view of the vent 1000. FIG. 8 is an exploded view of the vent 1000 illustrating various components thereof. The vent 1000 may be used in a roof, for example, a commercial roof. The vent 1000 may be especially useful in negating forces associated with wind uplift. In addition, the vent 1000 may be useful in facilitating removal of entrapped moisture from new and/or existing roof assemblies.

In example embodiments, the vent 1000 may be comprised of a base 100, an air flow guide 200, and a cover 300. In addition, the vent 1000 may include additional members such as, but not limited to, a flexible membrane 500 which may allow air to flow from the base 100 towards the air flow guide 200 where the air may leave the vent 1000 via one or more gaps between the air flow guide 200 and the cover 300.

Figure 9:
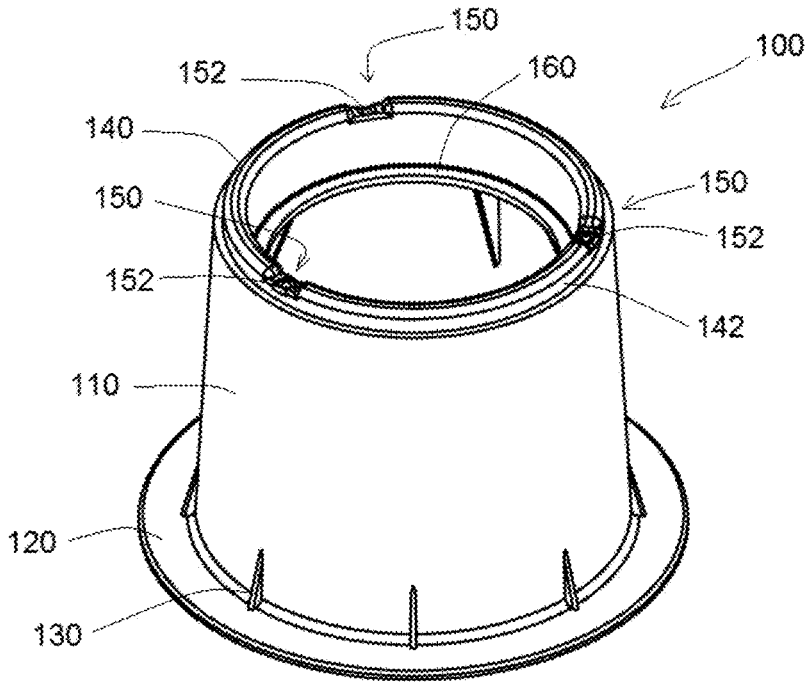
FIG. 9 is a perspective view of a base of the equalization vent in accordance with example embodiments.
Figure 10:
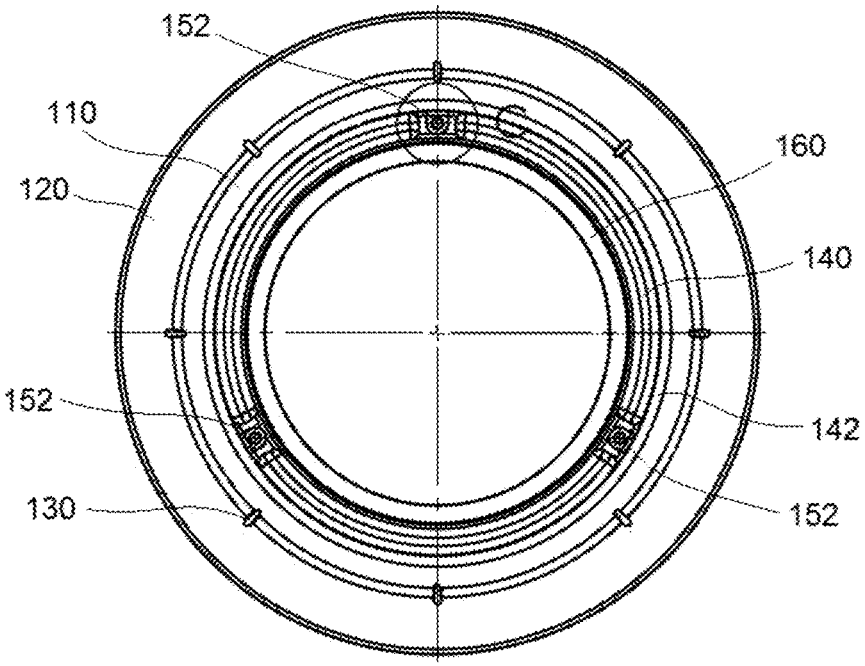
FIG. 10 is a top view of the base in accordance with example embodiments.
Figure 11:
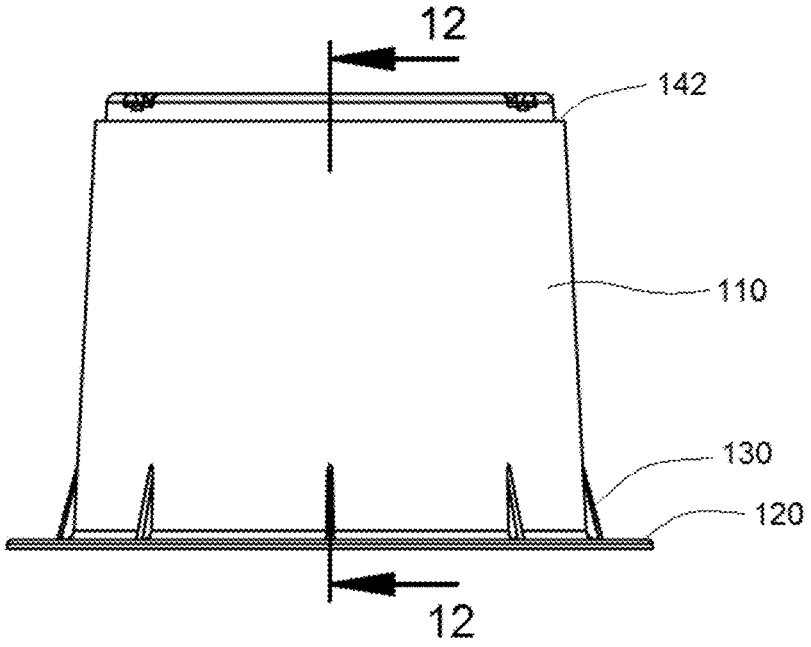
FIG. 11 is a side view of the base in accordance with example embodiments.
Figure 12:
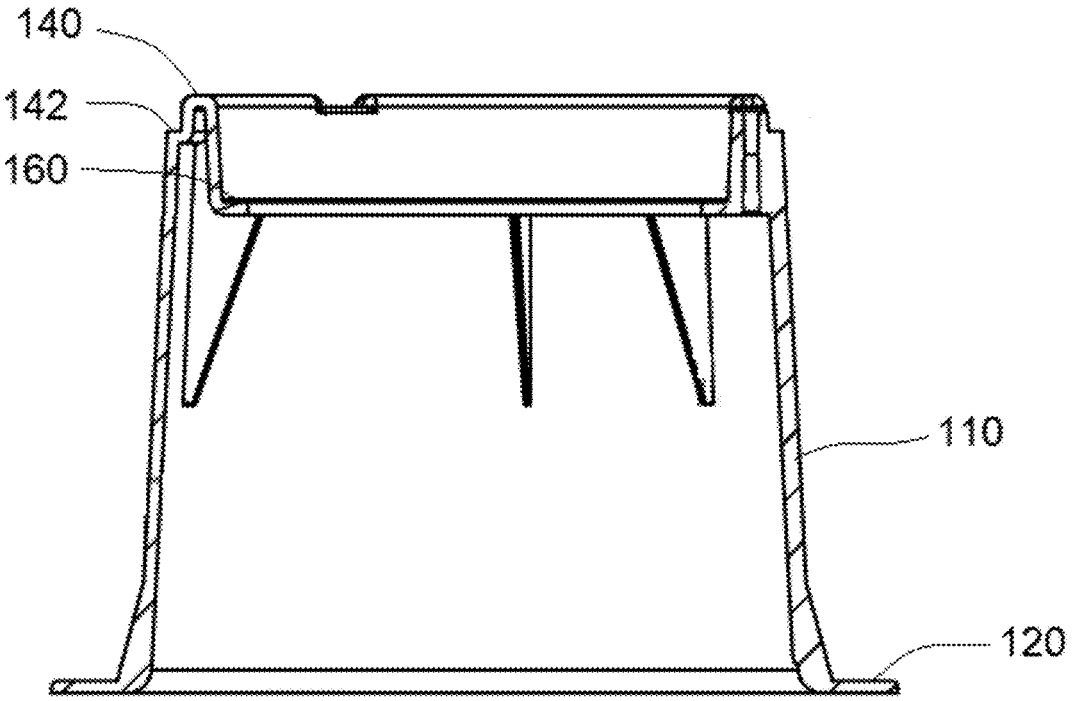
FIG. 12 is a cross-section view of the base in accordance with example embodiments.

FIG. 9 is a perspective view of the base 100, FIG. 10 is a top view of the base 100, FIG. 11 is a side view of the base 100, and FIG. 12 is a cross-section of the base 100. Referring to FIGS. 9-12 it is observed that the base 100 may include a body 110 and a flange 120 at a bottom of the body 110. As also shown in FIGS. 9-12, various gussets 130 may be provided to reinforce the interface between the body 110 and the flange 120.

In example embodiments the body 110 may resemble a cylinder having an annular cross-section. The flange 120 may resemble an annular ring having an inner diameter substantially the same as an inner diameter of the body 110 and an outer diameter larger than the inner diameter. In one nonlimiting example embodiment, the body 110 may be tapered such that, in profile, it appears as a truncated cone having sloped sides. In this nonlimiting example embodiment, the cross-sectional area of the body 110 may decrease slightly from a bottom of the body 110 to a top of the body 110. In example embodiments, the top of the body 110 may include ridge 140 and the ridge 140 may include various depressions 150 which may facilitate connecting the air flow guide 200 to the base 100. For example, the depressions 150 may include a threaded hole 152 which may receive a connecting member, for example, a fastener such as, but not limited to, a screw, which may be used to connect the air flow guide 200 to the base 100. In FIG. 9 the base 100 is shown as having three depressions 150 in the top ridge 140 thereof, however, this aspect of example embodiments is intended for the purpose of illustration only and is not intended to limit the invention as the inventive concepts disclosed herein are intended to cover vent bodies having ridges with more or less three depressions or even no depressions.

As shown in the figures, an outer diameter of the ridge 140 may be smaller than an outer diameter of the body 110. This creates a stepped area 142 which may support a bottom surface 212 of the air flow guide 200.

Figure 13:
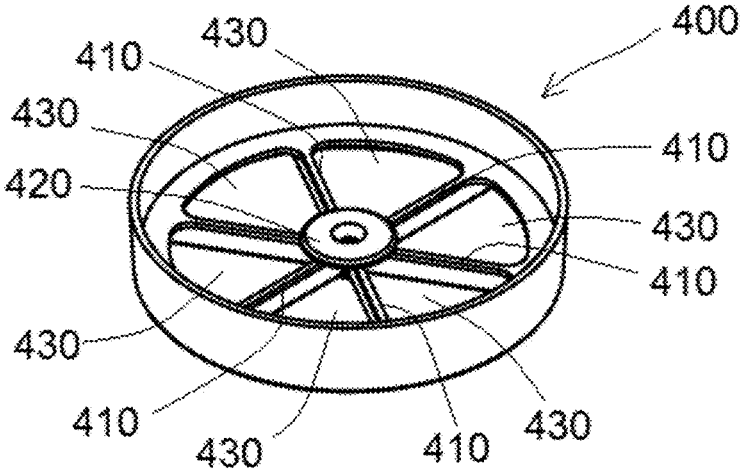
FIG. 13 is a perspective view of a cup in accordance with example embodiments.

In example embodiments, the body 110 may include an internal shoulder 160 which may resemble a ring. The internal shoulder 160 may be spaced below the ridge 140. The shoulder 160 may support a support cup 400 which may, in turn, support the flexible membrane 500. FIG. 13 illustrates a nonlimiting example of the cup 400 in accordance with example embodiments. As shown in FIG. 13, the cup 400 may resemble a short cylinder having spokes 410 that terminate in a central hub 420 which may resemble a short cylinder having a receiving area or a post. An outer diameter of the cup 400 may be about the same as an inner diameter of the body 110 at the internal shoulder 160. This closeness in diameters will prevent the cup 400 from having any significant lateral movement in the body 110. In FIG. 13 apertures 430 are present in order to allow air to flow through the cup 400. Although the embodiment of FIG. 13 illustrates the cup 400 as having six spokes 410 and six apertures 430, it is understood that the number of apertures and spokes is for the purpose of illustration only as the cup 400 may be embodied in various forms which may include more or less than six spokes and/or apertures.

Figure 14:
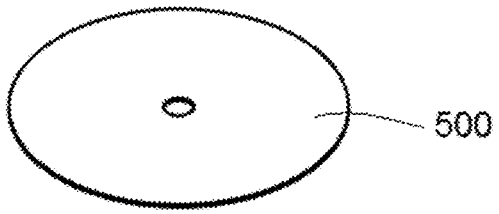
FIG. 14 is a perspective view of a flexible member in accordance with example embodiments.
Figure 15:
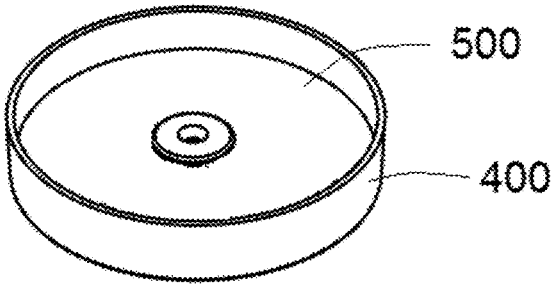
FIG. 15 is a perspective view of the flexible member in the cup in accordance with example embodiments.

FIG. 14 illustrates an example of the flexible membrane 500 in accordance with example embodiments. As shown in FIG. 14, the flexible membrane 500 may resemble an annular membrane having an outer diameter about the same as an inner diameter of the cup 400 and an inner diameter about the same as the hub 420. This allows the flexible membrane 500 to reside in the cup 400 as shown in FIG. 15. The flexible membrane 500 may be made from synthetic rubber, for example, EPDM, or other similar material.

Figure 16:
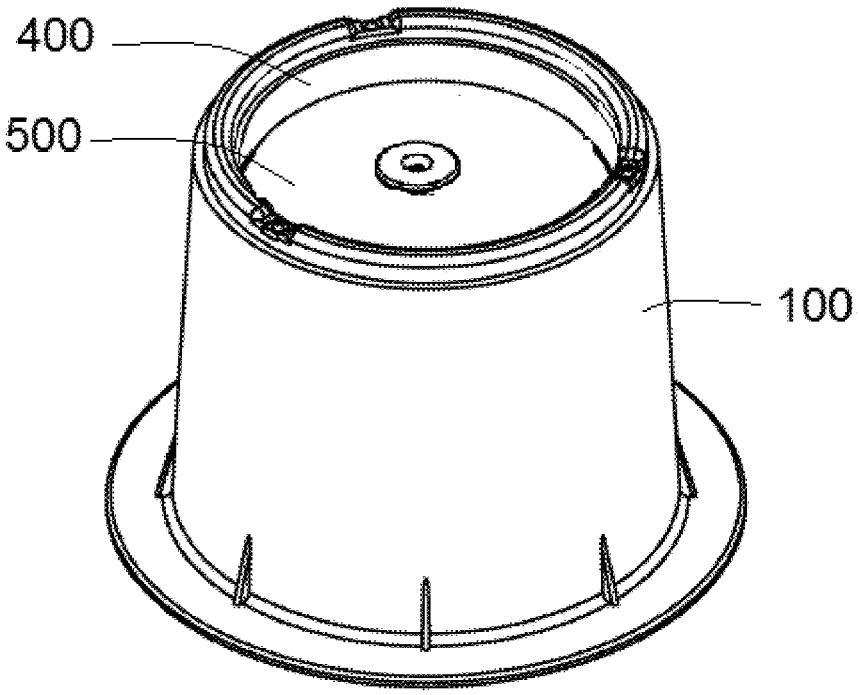
FIG. 16 is a perspective view of the flexible member in the cup in the base in accordance with example embodiments.

FIG. 16 illustrates the cup 400 with the flexible membrane 500 seated in the base 110. As shown in FIG. 16, cup 400 is vertically supported by the shoulder 160 and laterally restrained by the inner walls of the body 100. Because the spokes 410 support the underside of the flexible membrane 500 the spokes 410 prevent the flexible membrane 500 from deforming in a downward direction. This configuration, therefore, prevents air from moving downward through the base 100. However, the flexible membrane 500 is free to deform upwards thus allowing air to flow upward through the body 100.

In example embodiments, the flexible membrane 500 and cup 400 essentially function as a valve allowing air to flow through the base 100 and out of the vent 1000 when pressure outside the vent 1000 is less than the pressure inside the base 100. As one skilled in the art would readily recognize, the valve would also prevent air from flowing into the base 100 when the pressure outside the vent 1000 is greater than pressure in the base 100. Other variations of the valve fall within the inventive concepts recited in this application. For example, rather than having a membrane 500 supported in a cup 400 as illustrated in the figures, the cup 400, rather than having spokes 410, may have a perforated floor which supports the membrane 500. In this embodiment, the perforations allow for air to flow through the cup 400. As yet another example, rather than a cup 400 the flexible membrane 500 may be supported by a flat perforated disk which may be seated on the shoulder 160 of the base 100. As yet another example, the valve may be comprised of a relatively light and stiff circular plate hinge connected to a cup like structure seated on the shoulder so that when the pressure outside of the vent 1000 is less than the pressure inside the body 100 the differential air pressure causes the plate to rotate upwards allowing air to pass through the base 100 and out of the vent 1000. Regardless, membrane 500 and the cup 400, illustrate an example of valve which may be placed in the body 100 to allow air to flow from the body 100 and out of the vent 1000 when the pressure outside the vent 1000 is less than pressure inside the body 100.

Figure 17:
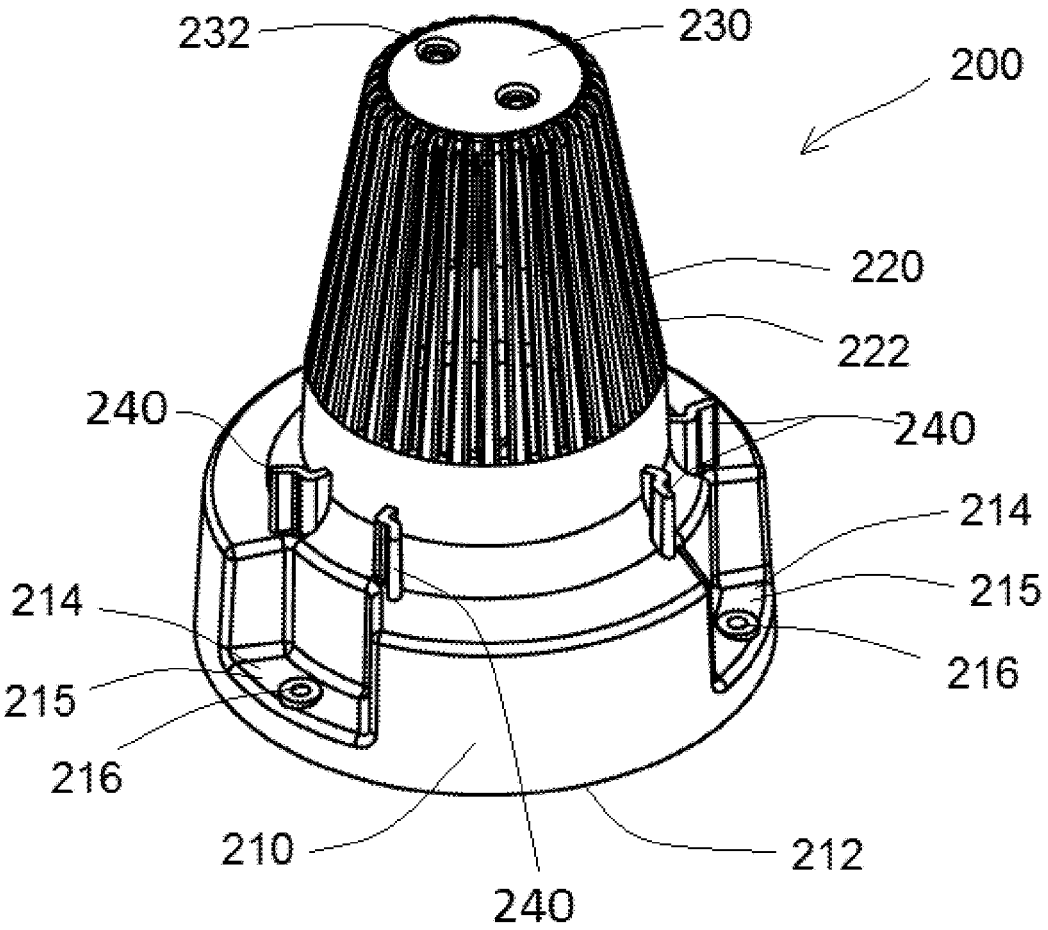
FIG. 17 is a perspective view of an air flow guide in accordance with example embodiments.
Figure 18:
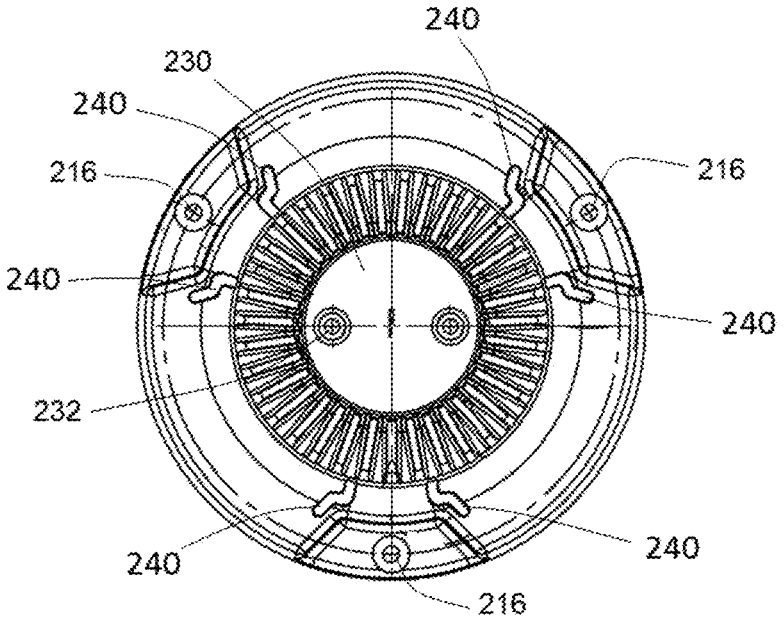
FIG. 18 is a top view of the air flow guide in accordance with example embodiments.
Figure 19:
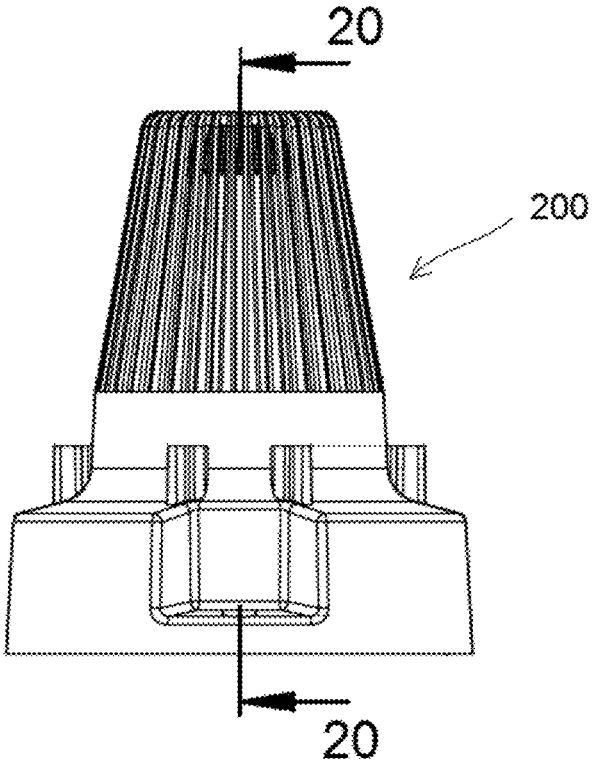
FIG. 19 is a side view of the air flow guide in accordance with example embodiments.
Figure 20:
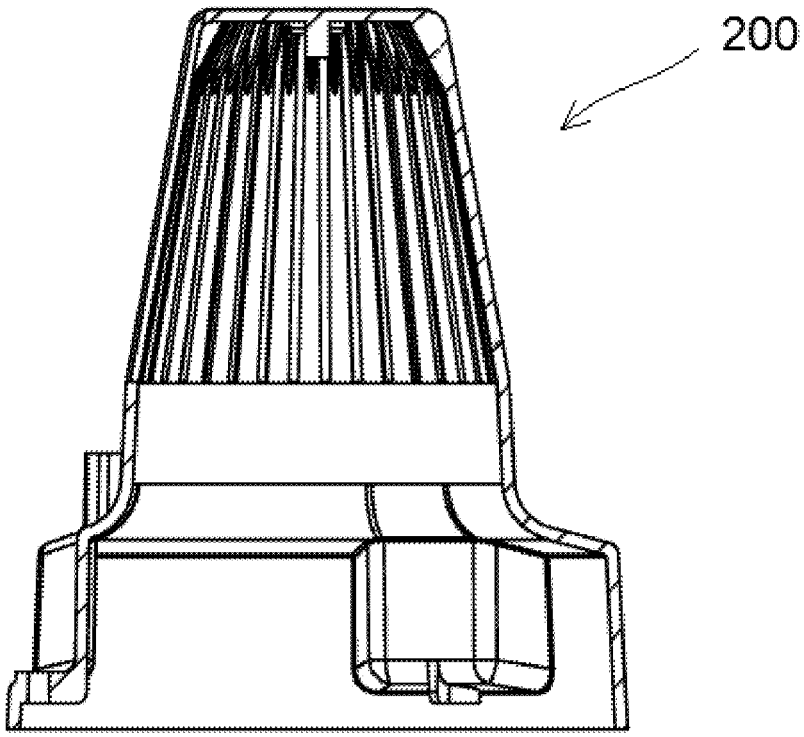
FIG. 20 is a cross-section view of the air flow guide in accordance with example embodiments.

FIG. 17 is a perspective view of the air flow guide 200. FIG. 18 is a top view of the air flow guide 200, FIG. 19 is a side view of the air flow guide 200, and FIG. 20 is a cross-section view of the air flow guide 200. As shown in FIGS. 17-20, the air flow guide 200 may include a base 210 with a guide 220 extending therefrom. The guide 220 may include a plurality of apertures 222 which may allow air to flow out of the air flow guide 200. As shown in the figures, the guide 220 may resemble a truncated cone, however, in another embodiment, the guide 2200 resembles a cylinder. In yet another embodiment, the guide resembles a tube having a polygonal cross-section.

In example embodiments, the air flow guide 200 may be a substantially hollow structure. For example, the base 210 may resemble a short cylinder having an inside diameter about the same (or slightly larger than) the outside diameter of the ridge 140. The outside diameter of the base 210 may be about the same as the outside diameter of the body 110 just below the ridge 140 so that when the air flow guide 200 is placed on the base 110 a stepped surface between the air flow guide 200 and the base 100 may be avoided. In other words, the outside surfaces of the base 210 and the base 100 may appear as one continuous surface. Having a smooth surface may promote better air flow around the vent 1000 which may aid in the vents overall efficiency.

Figure 21:
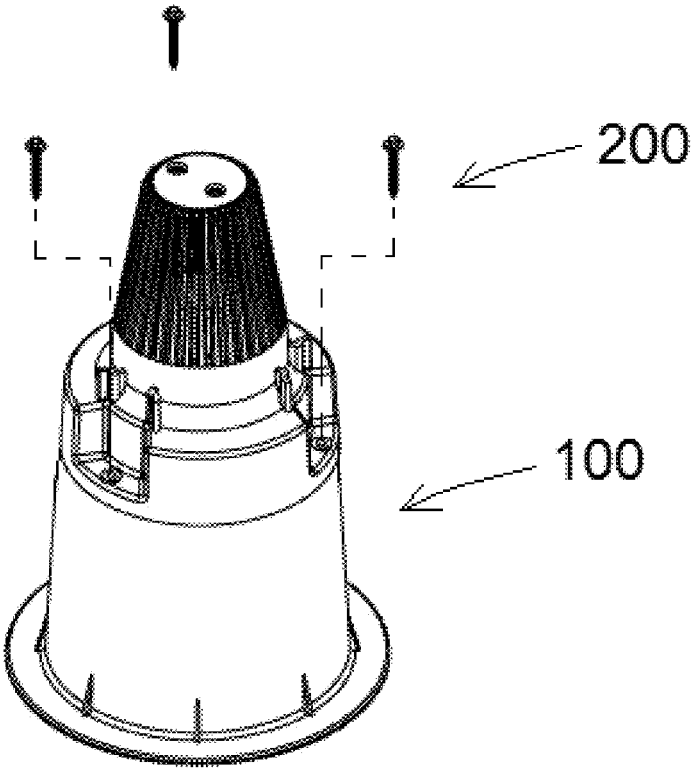
FIG. 21 is a perspective view of the air flow guide on the base in accordance with example embodiments.

In example embodiments the base 210 of the air flow guide 200 may include one or more indents 214 having bottom surfaces 215 with holes 216 that may facilitate connecting the air flow guide 200 to the base 100. For example, in the embodiment of FIGS. 9-12 the base 100 includes three depressions 150 having threaded holes 152. The air flow guide 200 includes three indents 214 having holes 216 so that when the air flow guide 200 is placed on the base 100 the bottom surface 212 of the air flow guide 200 is seated on the stepped area 142 of the base 100 such that holes 216 of the indents 214 are aligned with the holes 152 of the base 100. Conventional fasteners, for example, screws, may then be used to fasten the air flow guide 200 to the base 100. FIG. 21, for example illustrates the air flow guide 200 attached to the base 100 via the aforementioned fasteners.

In example embodiments, the air flow guide 200 may include a top 230 which may resemble a flat plate having at least one hole 232 therein. In FIG. 17, for example the at least one hole 232 is represented as a pair of holes 232. In example embodiments, the at least one hole 232 may be used to connect the air flow guide 200 to the cover 300 as will be explained shortly.

It is understood that the manner in which the air flow guide 200 is attached to the base 100 is not meant to limit the invention. For example, rather than using screws, rotating latches, for example, over center latches, may be provided to attach the air flow guide 200 to the base 100. As yet another example, an outer surface of the ridge 140 may include threads which may mate with threads which may be present on the inside surface of the base 210. In this latter embodiment, the air flow guide 200 simply screws onto the base 100.

Figure 22:
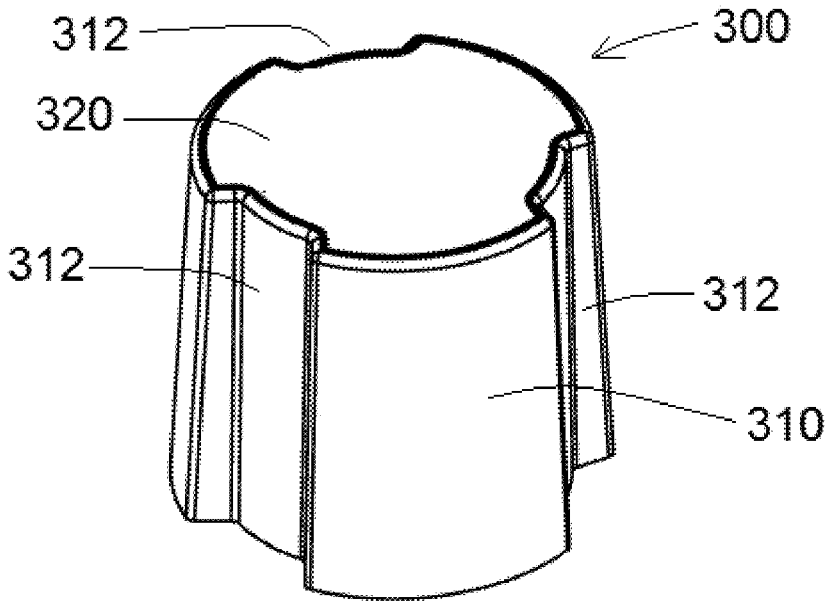
FIG. 22 is a perspective view of a cover in accordance with example embodiments.
Figure 23:
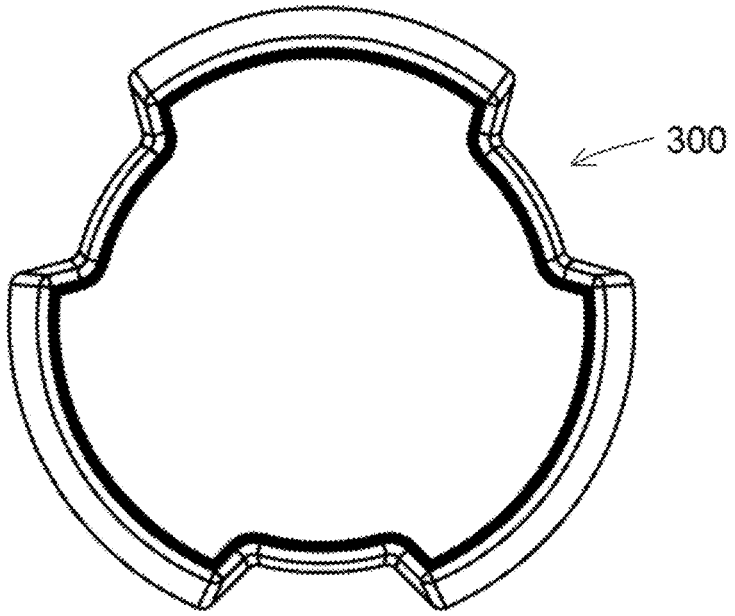
FIG. 23 is a top view of the cover in accordance with example embodiments.
Figure 24:
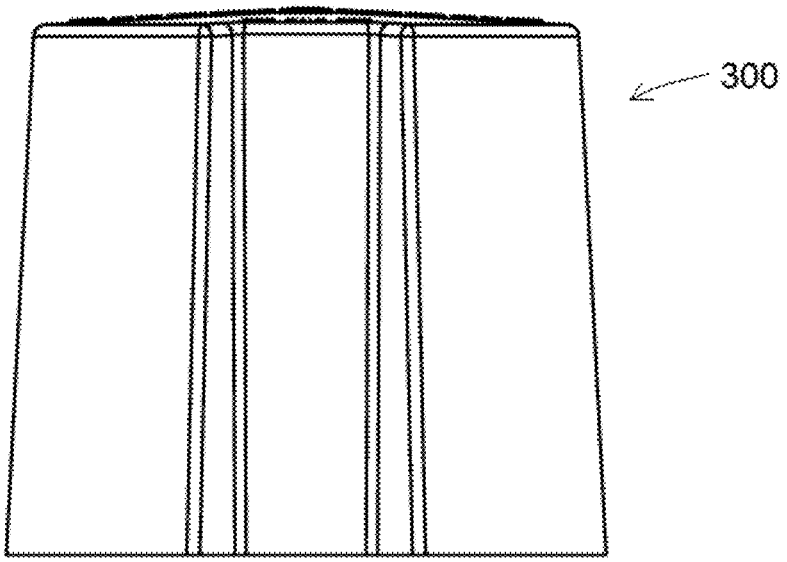
FIG. 24 is a first side view of the cover in accordance with example embodiments.
Figure 25:
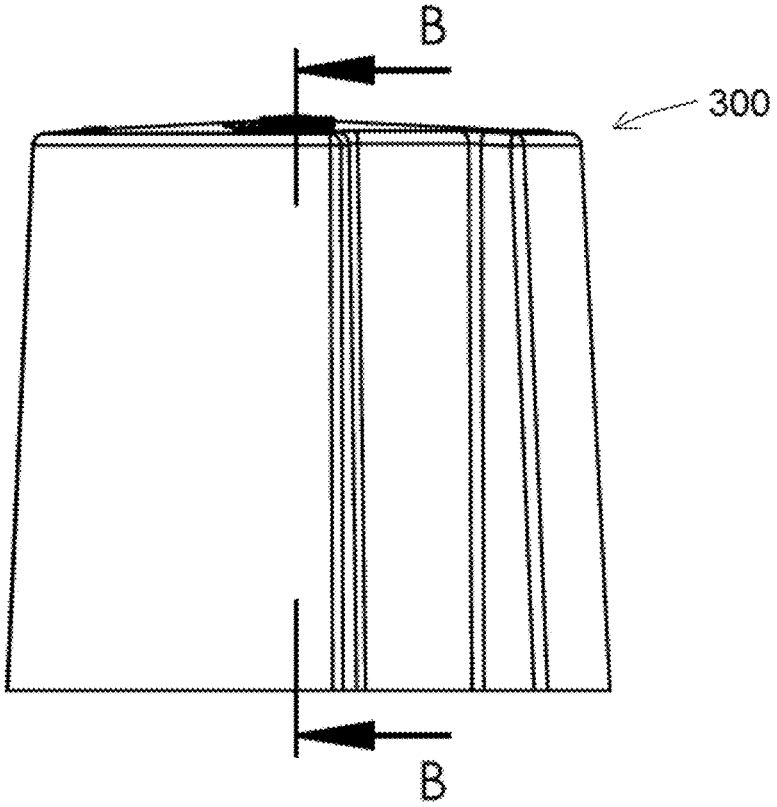
FIG. 25 is a second side view of the cover in accordance with example embodiments.
Figure 26:
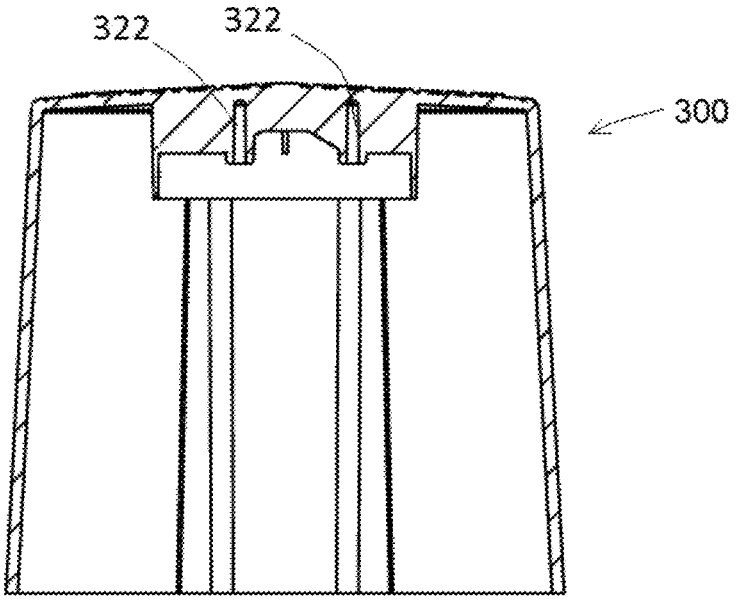
FIG. 26 is a section view of the cover in accordance with example embodiments.
Figure 27:
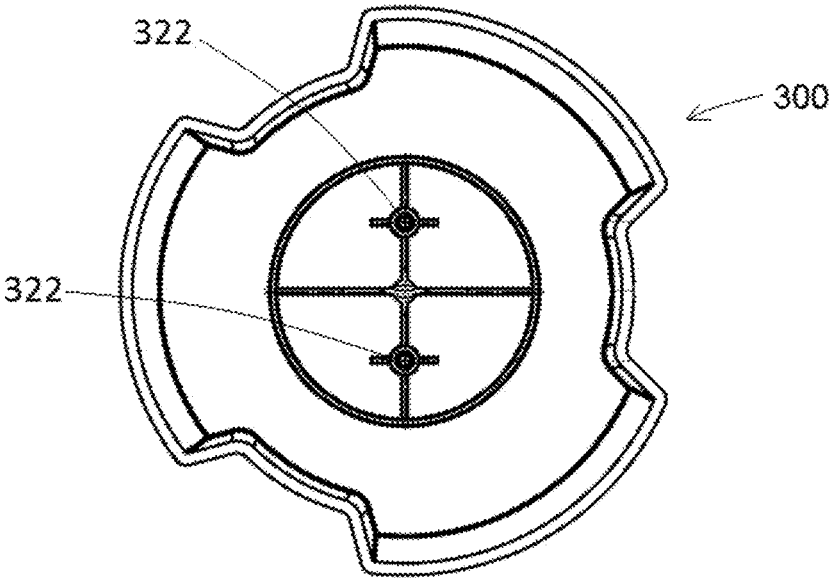
FIG. 27 is a bottom view of the cover in accordance with example embodiments.

FIG. 22 is a perspective view of the cover 300. FIG. 23 is a top view of the cover 300, FIG. 24 is a side view of the cover 300, FIG. 25 is another side view of the cover 300, FIG. 26 is a section view of the cover 300, and FIG. 27 is a view looking into the cover 300 from a bottom of the cover 300. As shown in FIGS. 22 to 27, the cover 300 resembles a cup having cylindrical body 310 and a top 320. As shown in FIGS. 22-27, the cylindrical body 310 may include one or more indents 312 which, when the cover 300 is mounted on the air flow guide 200, may align with the one or more indents 214 of the air flow guide 200. On the bottom side of the top 320 a mounting region having threaded holes 322 may be provided which, when the air flow guide 200 is placed into the cover 300, aligns with the holes 232. In this way, screws, or another type of fastener, may be used to attach the air flow guide 200 to the cover 300.

In example embodiments, the vent 1000 may include additional features. For example, in one nonlimiting example embodiment the air flow guide 200 may include a plurality of guides 240 which may interface with inside surfaces of the indents 312 of the cover 300. The guides 240 not only stabilize the cover 300 on the air flow guide 200 but act as spacers so air may flow through the air flow guide 200 and into a space between the air flow guide 200 and the cover 300 to exit the vent 1000.

Figure 28:
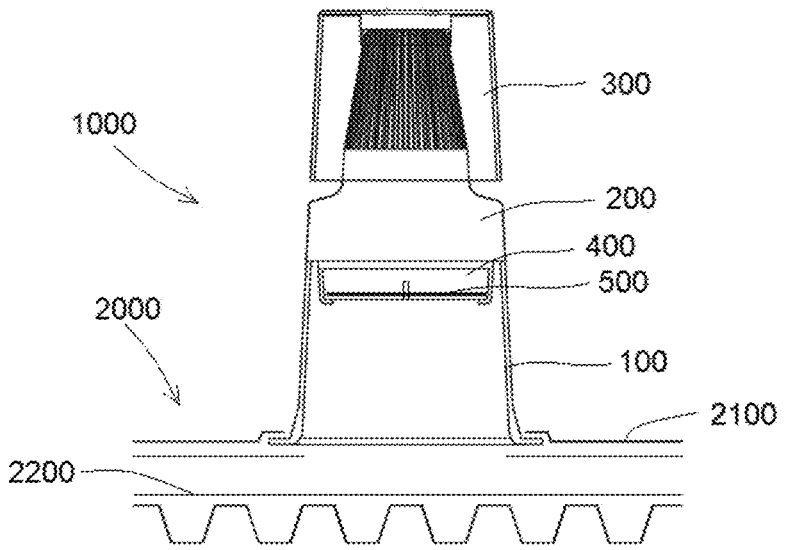
FIG. 28 is a section view of the equalization vent on a roof in accordance with example embodiments.
Figure 29:
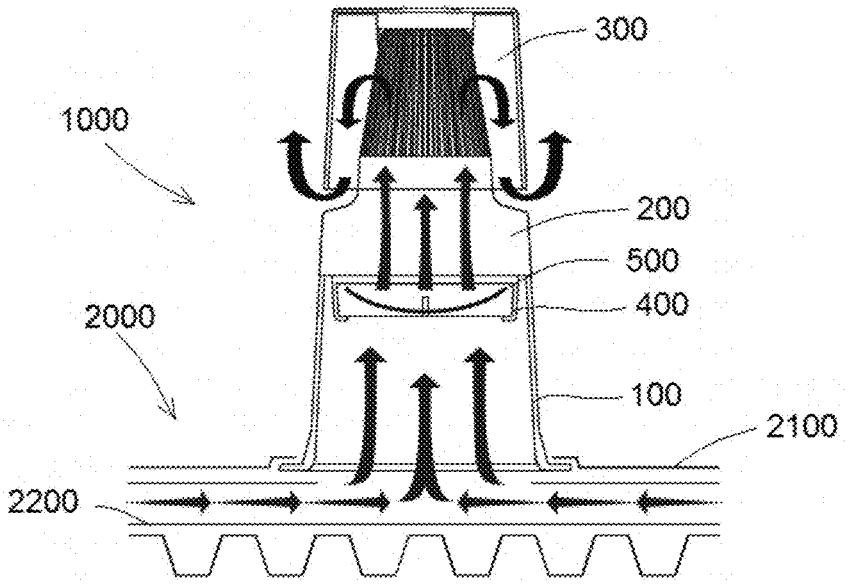
FIG. 29 shows air flow through the section view of the equalization vent on a roof when pressure outside the base is less then pressure inside the base in accordance with example embodiments.

FIG. 28 illustrates the vent 1000 installed in a roof 2000. As shown in FIG. 28, the roof 2000 may include a roof membrane 2100 and existing members 2200. In the event air around the vent 1000 is at a higher pressure than the air in the roof 2000, the air around the vent 1000 is prevented from moving into the roof 200 due to the presences of the flexible membrane 500 which blocks a flow of air from passing through the base 100. However, if the air outside of the vent 1000 is at a lower pressure than the air in the roof 2000, air in the roof 2000 may pass through the base 100, through the cup 400 (due to the fact that the flexible membrane 500 may flex upwards), through the air flow guide 200, and out of the vent 1000 vis a vie the spaces between the air flow guide 200 and the cover 300. In FIG. 29, the arrows represent air movement through the roof 2000 and the vent 1000 when pressure is lower above the roof 2000. It is understood that the air flowing through the vent 1000 may carry some moisture from the roof 2000 to the outside environment. This action encourages a drying of the roof 2000. In addition, the movement of air out of the roof 2000 (via the vent 1000) lowers the pressure in the roof 2000 thereby lessening a pressure differential between the roof 2000 and the environment reducing the tendency of the roof 2000 to lift upwards. As a skilled artisan would understand, this may happen to the largest extent possible when 1000 is placed in the highest wind uplift pressure zones of the roof (typically the corners and perimeter).

The vent 1000 of example embodiments has several advantages over traditional equalization vents. For example, in example embodiments it is relatively easy to remove the guide 200 and the cover 300 from the base 100. This would allow a technician easy access to a roof without having to completely detach the vent 1000 from the roof as is always done. This allows, for example, a technician to easily peer into the base 100 of the vent 1000 to ensure the roof was properly cored and/or configured for optimal moisture removal. Second, Applicant has found that the structural design is extremely durable. For example, equalization vents having the structure described above suffer little damage in high winds and hail storms. This is in part due to the structural design of the guide 200. The guide 200 is relatively rigid, however, the apertures 222 impart a certain level of flexibility to the overall vent design thus allowing the vent 1000 to better withstand adverse weather conditions. Furthermore, Applicant has found the base 100, airflow guide 200, and cover 300 may be fabricated using injection molding making its manufacture thereof relatively easy and cost efficient.

As eluded to above, the vent 1000 of example embodiments allows a roof to which it is attached to be easily inspected and/or modified. For example, in example embodiments, the cover 300 of the vent 1000 may be taken off the base 100 by removing the fasteners that connect the air flow guide 200 to the base 100. The cup 400 with the flexible membrane 500 may then be removed to expose the roof through the base 100. These actions can all be performed while the base 100 remains in place and attached to the roof. With the air flow guide 200 and the cover 300 removed a technician can peer through the base 100 to inspect the roof. The opening of the base 100 may be of any size that allows a technician to observe the roof, however, it has been found that an opening of sixteen square inches or greater is acceptable. If the technician determines the roof should be modified, the user can modify the section of the roof under the vent 1000 by performing certain actions through the base 100 and while leaving the base attached to the roof. For example, if a deeper portion of the roof below the vent 1000 should be exposed, the technician may insert a tool through the base 100 and core out a section of the roof under the base 100. On the other hand, if the technician determines a section of the roof under the base 100 should be raised, the technician may add material to the roof through the base 100. For example, a technician could apply foam to the roof by passing the foam through the base 100 of the vent 1000 and applying the foam to the section of the roof under the vent 1000.

To the inventor's knowledge, the above described operations cannot be performed using conventional vents. First, conventional vents are generally not built in a modular fashion so that one part is easily removable from another. Due to this construction, vents are generally removed in whole from a roof when a portion of a roof under a vent requires modification. Second, the inventors are unaware of any vent having a base through which roofing modifications can be performed. To the inventor's knowledge, the bases of conventional vents are simply not configured to allow a technician to effectively pass tools through to modify the roof. Therefore, the bases of conventional vents are required to be removed in order to modify portions of the roof under the vents.

Figure 30:
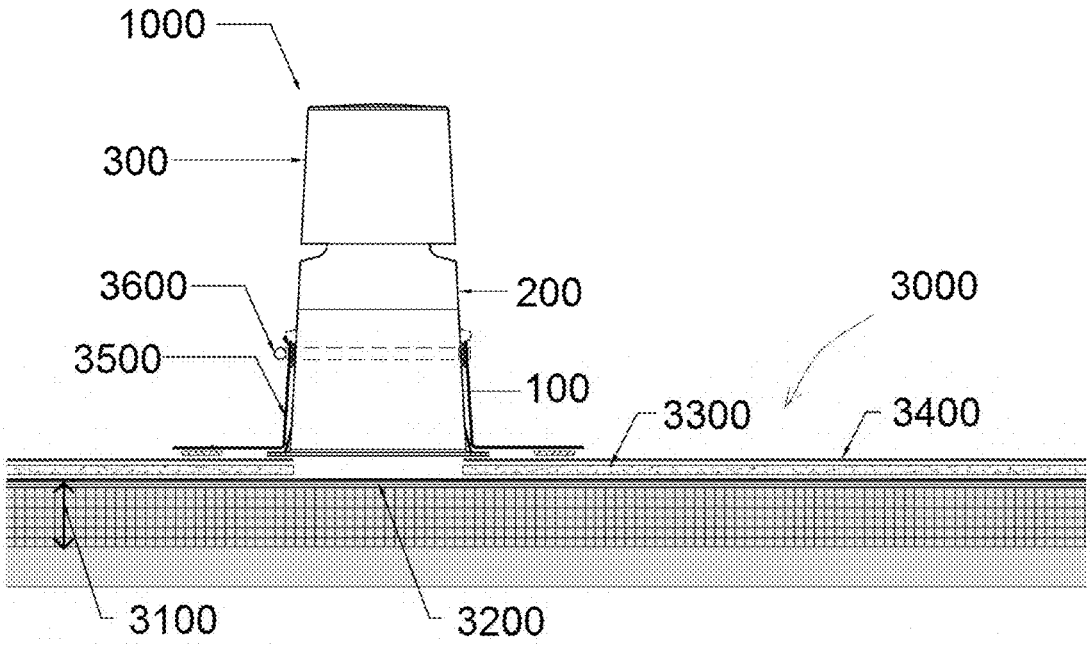
FIG. 30 is a view of the equalization vent on a roof in accordance with example embodiments.
Figure 31:
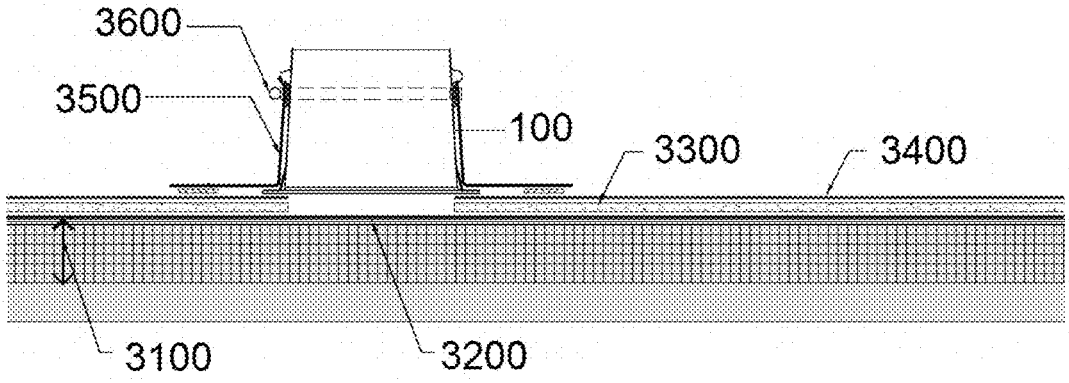
FIG. 31 is a view of the equalization vent with a cover and airflow guide removed in accordance with example embodiments.

For purposes of clarity, FIG. 30 illustrates an equalization vent 1000 mounted on a roof 3000 and placed in the high wind uplift zone of the roof 3000. The highest wind uplift zones are generally found at corners and perimeter of a roof. The roof 3000 includes a existing roof assembly 3100 with a roof membrane 3400 thereon. In this example, the roof member 3200 acts as an air barrier. A separate protective layer 3300, if required, is placed on the existing roof assembly 3200 and a roof membrane 300 is placed on any required protective separator 3300. A boot 3500 is applied over the base 100 of the vent 1000 and a clamping ring 3600 secures the vent 1000 to the boot 3500. If a technician wanted to inspect the roof 3000 under the vent 1000 the user could remove the cover 300 of the vent 1000 as shown in FIG. 31 and the technician could thereafter perform various operations, for example, removing part of the existing roof assembly if necessary or adding a material, for example, a foam material, to the roof. These operations can all be performed through the base 100 due to the base's size.

Figure 32:
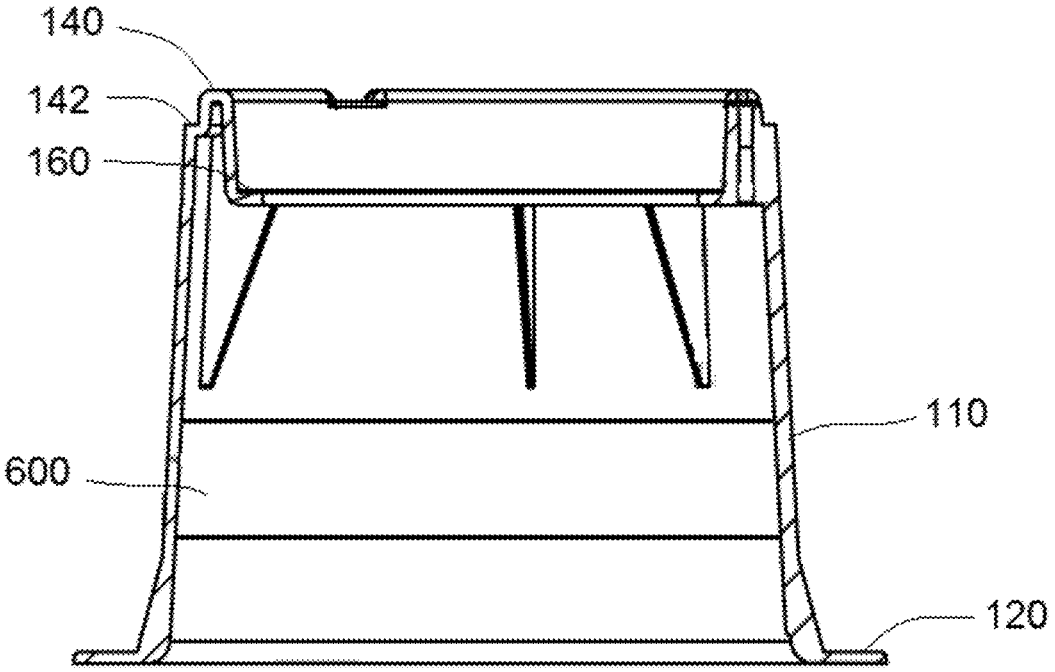
FIG. 32 is a view of a base having a sensor inside in accordance with example embodiments.

In example embodiments the vent 1000 may include additional elements. For example, a moisture sensor 600 may be placed in the base 100 and the moisture sensor may sense the humidity within the base 100. FIG. 32, for example, illustrates a section view of the base 100 having a sensor 600 mounted therein. The sensor 600 may send this data either by wire or wirelessly to a data collector which may provide useful information to maintenance personnel. For example, excessive moisture in the base 100 may indicate the vent 1000 is not functioning properly and may need to be replaced. In addition, the sensor data may be an indication of the moisture in the roof which may provide an indication as to the overall health of the roof. Further yet, the data may indicate whether the roof is properly functioning. For example, a moisture level which increases over time may indicate the roof is leaking and may need to be serviced. As yet another example, the moisture level may be compared to an expected moisture level and if the moisture level is higher than the expected moisture level, then this may mean the roof is retaining more water than expected and therefore should be serviced.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What we claim is:

1. A modular vent comprised of:

a base having an internal shoulder spaced apart from a top of the base;

a support cup on the internal shoulder and laterally restrained by the base, the support cup having a plurality of apertures at a base of the support cup to allow air to flow therethrough;

a flexible membrane on the base of the support cup;

an airflow guide on the base; and a cover on air flow guide, wherein the airflow guide is attached to the base by at least one removable fastener, wherein the flexible membrane is supported so that is free to flex towards the airflow guide to allow air to flow from the base through the airflow guide but is prevented from flexing towards a bottom of the base to prevent air from flowing towards a bottom of the base, and the internal shoulder prevents the support cup from moving towards a bottom of the base.

2. The modular vent of claim 1, wherein an end of the base facing the cover has an opening of at least 16 inches squared enabling a technician access to a roof to at least one of inspect and modify the roof.

3. The modular vent of claim 1, further comprising:

an air flow guide is attached to the cover by at least one fastener.

4. A vent comprising:

a base;

a cup arranged in the base;

a flexible membrane arranged in the cup;

an airflow guide arranged on the base and the cup; and a cover on the air flow guide wherein the flexible membrane allows air to flow through the vent when the pressure outside of the vent is less than the pressure inside the base and prevents air from flowing through the vent when the pressure outside of the vent is greater than pressure inside the base, and wherein the airflow guide includes an airflow guide base on a top of the base and a slotted guide extending from the airflow guide base into the cover, the slotted guide having an upper surface attached to an upper portion of the cover.

5. The vent of claim 4, wherein the cover is attached to the air flow guide by a first fastener and the air flow guide is attached to the base by a second fastener.

6. The modular vent of claim 1, wherein the air flow guide includes a base and a guide structure extending from the base, the guide structure extending towards the cover, the guide structure having a plurality of apertures to allow air to flow through the air flow guide.

7. The modular vent of claim 1, wherein the air flow guide includes a base and a guide structure extending from the base, the guide structure extending towards the cover, the guide structure having a plurality of elongated apertures to allow air to flow through the air flow guide and impart flexibility to the airflow guide.

8. The modular vent of claim 1, wherein the internal shoulder (160) resembles a ring.

9. The modular vent of claim 1, wherein the base includes a ridge with a plurality of depressions with holes and the airflow guide includes a plurality of indents with bottom surfaces having holes alignable with the holes of the plurality of depressions.

10. The modular vent of claim 1, wherein the base includes a ridge and a stepped area outside of the ridge.

11. The modular vent of claim 1, wherein the base includes a ridge and a stepped area outside of the ridge and a bottom of surface of the airflow guide is supported on the stepped area.

12. The modular vent of claim 1, wherein a top of the base includes a ridge having a diameter smaller than an outer diameter of the top of a body of the base forming a stepped area which supports the airflow guide.

13. The modular vent of claim 1, wherein the airflow guide includes a plurality of guides configured to contact internal surfaces of the cover to stabilize the cover.

14. The modular vent of claim 1, wherein the air flow guide includes a base and a guide structure extending from the base and towards the cover, the guide structure resembling a truncated cone having a plurality of apertures to allow air to flow through the air flow guide.

* * * * *